United States Patent [19]

Kojima

[11] 4,098,204

[45] Jul. 4, 1978

[54] APPARATUS FOR STRETCH-SEWING A HEM IN TUBULAR FABRIC

[75] Inventor: Toshihiko Kojima, Hyogo, Japan

[73] Assignee: Yamato Mishin Seizo Kabushiki Kaisha, Osaka, Japan

[21] Appl. No.: 703,115

[22] Filed: Jul. 6, 1976

[30] Foreign Application Priority Data

Sep. 5, 1975 [JP] Japan ..... 50-108421

[51] Int. Cl.[2] ..... D05B 21/00; D05B 33/00; D05B 35/10

[52] U.S. Cl. ..... 112/121.12; 112/121.26; 112/121.29; 112/147; 112/153

[58] Field of Search ..... 112/121.26, 121.27, 112/205, 204, 153, 143, 63, 147, 121.29, 121.12, 121.11

[56] References Cited

U.S. PATENT DOCUMENTS

| | | | |
|---|---|---|---|
| 2,952,227 | 9/1960 | Hale et al. | 112/143 |
| 3,182,619 | 5/1965 | Sally | 112/153 X |
| 3,609,373 | 9/1971 | Desai et al. | 112/205 X |
| 3,650,229 | 3/1972 | Rovin | 112/204 X |
| 3,693,561 | 9/1972 | Hrinko et al. | 112/204 X |
| 3,722,441 | 3/1973 | Kitchener et al. | 112/205 |
| 3,752,100 | 8/1973 | Sharp | 112/153 X |
| 3,783,805 | 1/1974 | Guichard | 112/121.26 X |
| 3,865,058 | 2/1975 | Rovin et al. | 112/121.26 X |
| 3,890,911 | 6/1975 | Babson et al. | 112/121.12 |

*Primary Examiner*—H. Hampton Hunter
*Attorney, Agent, or Firm*—Wenderoth, Lind & Ponack

[57] ABSTRACT

A tubular workpiece is fed toward a stitch forming means while forcing the marginal edge portion of the workpiece upwardly against an annular peripheral portion of a rotatable guide plate and then across an upper flat surface of the guide plate. This action automatically forms a substantially Z-shaped fold in the marginal portion of the workpiece. This fold is both interiorly and exteriorly guided so that the fold is formed into a triple-thickness hem which is thereafter sewn by the stitch former. The edge of the marginal portion of the workpiece is maintained in a predetermined alignment with respect to the direction of feed of the workpiece by rotating the guide plate in either the clockwise or counterclockwise directions. When the initial portion of the sewn hem of the tubular workpiece returns to a position adjacent the guide plate, the marginal portion of the workpiece is no longer forced against the annular peripheral surface of the guide plate, and also the interior guiding of the fold is discontinued, thereby preventing jamming of the initial sewn hem portion. A predetermined time after the detection of the initial sewn hem portion, the exterior guiding of the fold is stopped, and the guide plate is rotated in a clockwise direction to remove the hemmed workpiece from the guide plate.

7 Claims, 13 Drawing Figures

APPARATUS FOR STRETCH-SEWING A HEM IN TUBULAR FABRIC

BACKGROUND OF THE INVENTION

The present invention relates to an apparatus and method for automatically forming and sewing a hem in the free edge of a looped or circular article of clothing.

It has heretofore been difficult to automatically and mechanically perform the type of finishing sewing operation wherein a looped or tubular article of clothing such as a shirt or skirt has the free end thereof folded and hemmed at a constant width. This type of operation is referred to as a "stretch-sewing" operation. Specifically, since the article of clothing has a looped shape, the operations of forming a proper fold automatically and then transferring the article to a sewing machine is difficult, and has normally been performed manually by a skilled worker, even when the other sewing operations could be performed fully automatically and mechanically. Thus, this stretch-sewing process has heretofore been a very inefficient operation.

SUMMARY OF THE INVENTION

A primary object of the present invention is to provide a method whereby stretch-sewing of a tubular fabric article can be performed fully automatically rather than by the customary manual operation.

A further object of the invention is to provide a mechanical apparatus to perform such stretch-sewing operation.

An even further object of the invention is to provide a system wherein an unskilled operator can perform such stretch-sewing operation.

A still further object of the invention is to provide a system wherein such stretch-sewing operation can be performed at high efficiency.

A yet further object of the invention is to provide a system wherein such stretch-sewing operation can be performed while exactly ensuring a desired hem width.

These objects are achieved according to the present invention by providing a system wherein the entire hemming operation starting from the initial formation of the fold up to sewing operation is fully automatically and mechanically performed, whereby it is possible for even an unskilled worker to perform a precise stretch-sewing operation easily and at high efficiency.

BRIEF DESCRIPTION OF THE DRAWINGS

Other objects and features of the invention will become apparent from the following detailed description, taken with the accompanying drawings, wherein.

DETAILED DESCRIPTION OF THE INVENTION

Figure 1:
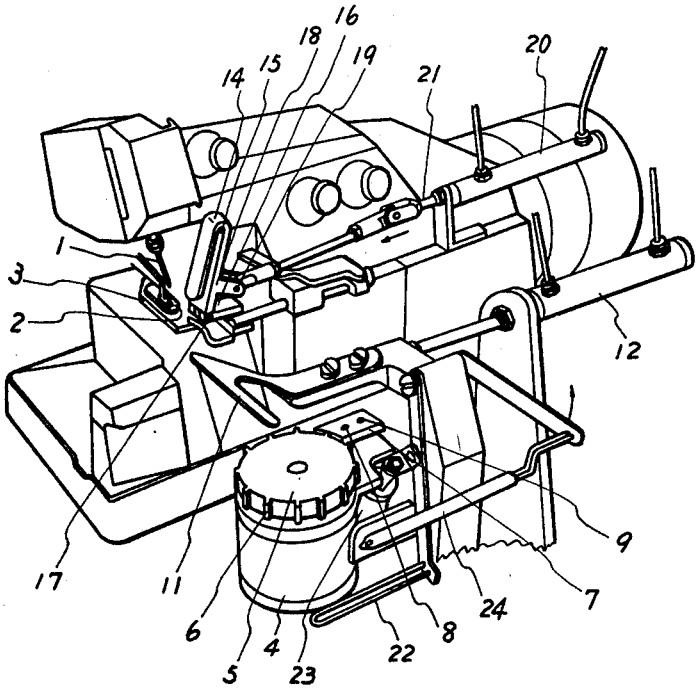
FIG. 1 is a perspective view of the apparatus of the invention as positioned before the start of a sewing operation.

One practical embodiment of the present invention will now be described in detail.

In the drawings, 1 is a conventional sewing needle, 2 a conventional presser foot, and 3 a conventional needle plate. These are known elements of a conventional sewing mechanism and form a stitch-forming device. 4 is a motor for controlling the orientation of the free edge of a looped or circular cloth article 10. A guide plate 5 is a circular plate-like body and has a plurality of slip-resisting projections 6 extending outwardly in the radial direction from the periphery thereof.

Figure 2A:
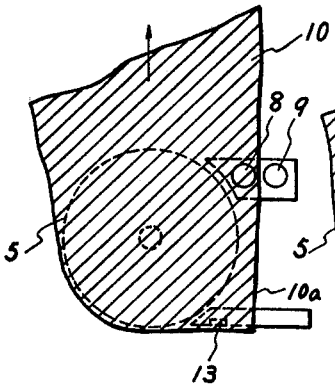
FIGS. 2*a*, 2*b* and 2*c* are partial plan views showing the relative positions between first and second photo-receiving elements and an advancing edge of a cloth to be hemmed, FIG. 2*a* showing the normal position of the edge, FIG. 2*b* showing the edge moved too far leftwardly, and FIG. 2*c* showing the edge moved too far rightwardly.
Figure 2B:
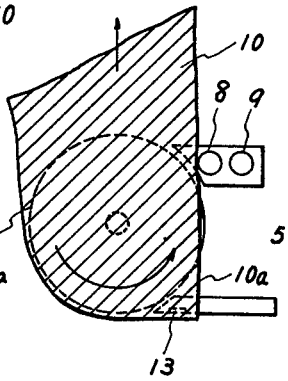
Figure 2C:
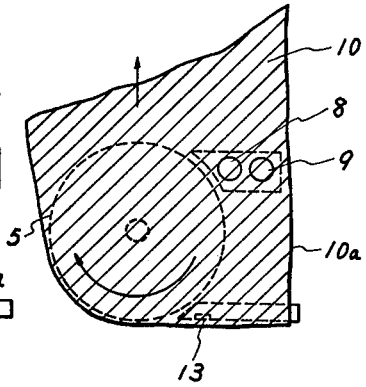

A photo-receiving base element 7 supports a first photo-receiving element 8 and a second photo-receiving element 9 at positions adjacent each other. Elements 8 and 9 control the operation of motor 4 such that when first photo-receiving element 8 is covered by cloth article 10 and second photo-receiving element 9 is exposed as shown in FIG. 2*a*, the cloth article advances normally toward sewing needle 1 by means of a conventional feeder (not shown), and motor 4 is stopped. Accordingly, guide plate 5 is also stopped. However, if the edge deviates to a position such that both photo-receiving elements 8 and 9 are exposed as shown in FIG. 2*b*, i.e. such that edge 10*a* of cloth 10 has moved leftwardly, then motor 4 and guide plate 5 are slightly rotated counterclockwise, as shown by the arrow, and end 10*a* of cloth 10 is automatically returned to the position shown in FIG. 2*a*. Similarly, if edge 10*a* deviates to a position such that both photo-receiving elements 8 and 9 are covered by cloth 10, as shown in FIG. 2*c*, i.e. such that edge 10*a* of cloth 10 has moved rightwardly, then motor 4 and guide plate 5 are slightly rotated clockwise, as shown by the arrow, and the cloth moves leftwardly to automatically return edge 10*a* to the position shown in FIG. 2*a*.

A cloth or fold guide 11 has a base end mounted to be automatically advanced or retracted by an air cylinder 12. A third photo-receiving element 13 is mounted at a position adjacent the front and lower side of guide plate 5. Element 13 controls air cylinder 12 such that when photo-receiving element 13 is exposed, air cylinder 12 is operated to retract cloth guide 11.

Figure 3:
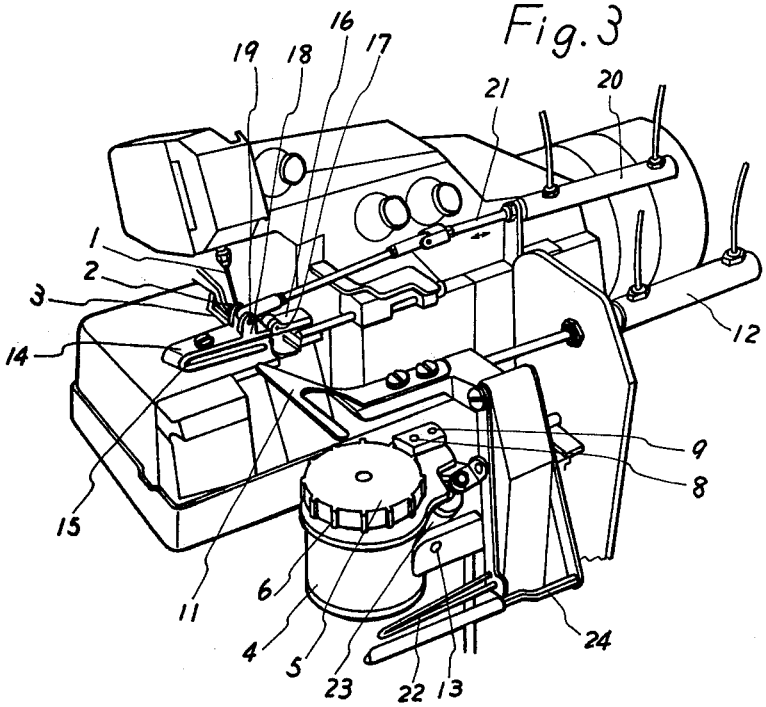
FIG. 3 is a perspective view of the apparatus of FIG. 1 positioned for normal sewing operation but with the cloth not shown for clarity of illustration.

A hemming guide or folder 14 has a bent or U-shaped configuration forming a cavity 15 serving to exteriorly pinch or guide the fold formed in cloth 10. Folder 14 has a base end 16 which is pivoted at 17 to the sewing machine base, and an intermediate part 18 which is connected at joint 19 to piston 21 of air cylinder 20. When piston 21 is extended to the left as shown by the arrow in FIG. 3, folder 14 is moved down leftwardly as shown in FIG. 3, and when piston 21 is receded, folder 14 is raised upwardly to the position shown in FIG. 1.

A cloth-handling bar 22 is mounted so as to be raised or lowered by an air cylinder 23 which is operated by exposure of third photo-receiving element 13. A cloth-pinching bar 24 is mounted so as to be raised or lowered either alone or together with cloth-handling bar 22. Cloth 10 is pinched between bars 22 and 24 and is guided by these bars as it is advanced in the direction of sewing.

The operation of the present invention will now be described.

Figure 4:
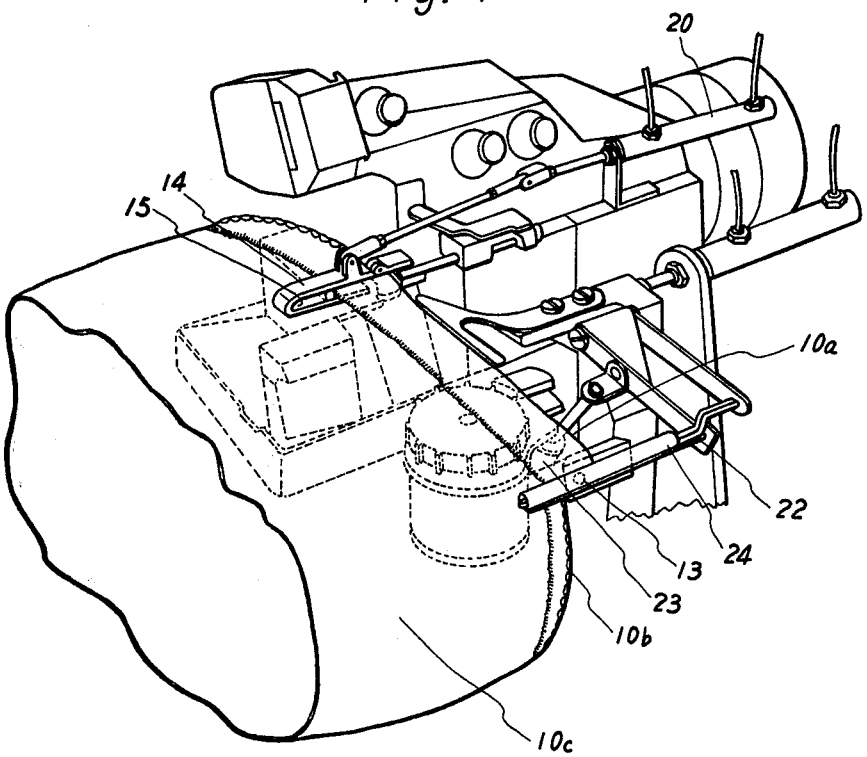
FIG. 4 is a partial perspective view similar to FIG. 3, but wherein the beginning end of the sewn hem approaches the position of third photo-receiving element.
Figure 6:
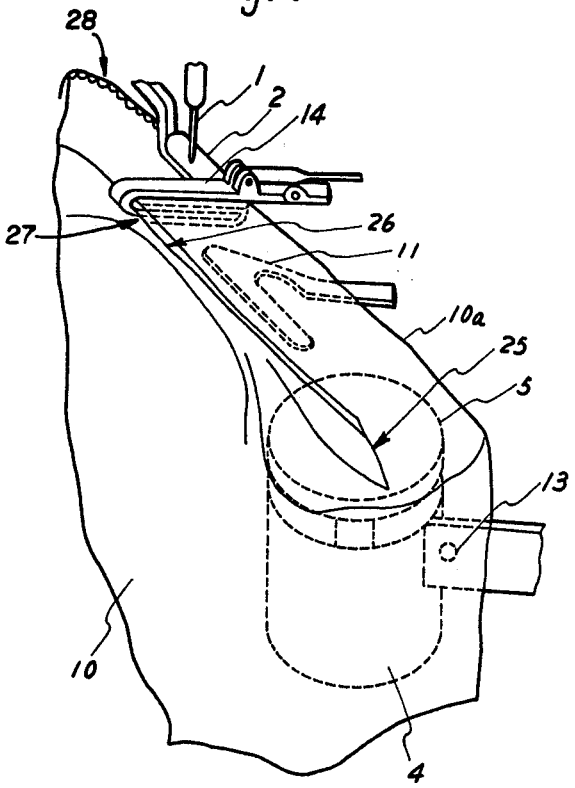
FIG. 6 is a perspective view showing the sequence of folding and sewing the hem.
Figure 7:
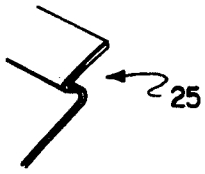
FIGS. 7–10 are partial perspective views illustrating different configurations of the edge of the article of clothing as it is folded and hemmed according to the invention.
Figure 8:
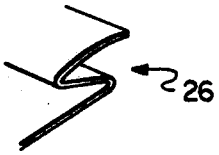
Figure 9:
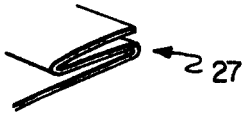

At the start of a sewing operation the apparatus is in the position shown in FIG. 1, i.e. cloth-handling bar 22 is located at its lower position and cloth-pinching bar 24 is in raised position. Therefore, a portion of the free edge of a looped cloth article 10 can easily be inserted between bars 22 and 24. Next, the cloth article is raised so as to cover guide plate 5, and the edge of the cloth article is positioned so that it passes between first photo-receiving element 8 and second photo-receiving element 9. Bar 24 is lowered to thereby pinch or grip the cloth article, and this tends to pull the cloth article downwardly and away from guide plate 5. When this occurs, the cloth article, which has been flat, comes into contact with and travels along the outer circumference of guide plate 5. Accordingly, the marginal portion of the article changes into a curved or Z-shaped configuration 25 as shown in FIGS. 6 and 7. Configuration 25 is basically a curving of the article tending to form a fold. Then, air cylinder 12 is advanced and fold guide 11 is inserted between the folds of configuration 25. When guide 11 is so inserted, curved configuration is formed into a pleat or triple-thickness fold 26 as shown in FIGS. 6 and 8. Next, pleat 26 is inserted into the cavity 15 of folder 14 which is still in the raised position shown in FIG. 1. Piston 21 is advanced such that folder 14 is moved down to the horizontal position shown in FIGS. 3 and 6. At this time, the edge of cloth article 10 is positioned upwardly, and the pleat is inserted into cavity 15 in the configuration 27 shown in FIGS. 6 and 9. Body 10*c* of the cloth article is spread widely leftwardly around the lower face of folder 14 as shown in FIGS. 4 and 6. Thus, the folded edge in the configuration 27 extends between needle plate 3 and presser foot 2. The sewing operation may be started upon lowering the pressor foot 2.

Figure 10:
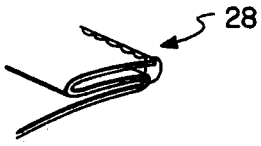

Then, when the sewing operation is commenced by starting the sewing machine, the edge is sewn to form hem 28, as shown in FIGS. 6 and 10. The edge of the cloth article is stretched between bars 22 and 24 and pressor foot 2 and needle plate 3. Thus, stretch-sewing is performed automatically and mechanically, while the edge continues to be folded and pleated mechanically and automatically during the sewing operation. Thereby, a skilled manual operation to form, fold and guide the edge is completely unnecessary, and even an unskilled worker can operate the apparatus of the invention to perform accurate and uniform stretch-sewing.

Thereafter, when the position of edge 10*a* of cloth article 10 advances too far rightwardly during the sewing operation, the cloth covers not only first photo-receiving element 8 but also second photo-receiving element 9, as shown in FIG. 2*c*. Accordingly, control motor 4 is actuated to rotate guide plate 5 slightly in the clockwise direction so that the cloth is moved leftwardly until edge 10*a* of the cloth is returned to a position at which it is positioned between first photo-receiving element 8 and second photo-receiving element 9, at which time motor 4 is stopped. Similarly, when edge 10*a* is moved too far leftwardly such that not only second photo-receiving element 9 but also first photo-receiving element 8 are both exposed as shown in FIG. 2*b*, control motor 4 is actuated to rotate guide plate 5 in the counterclockwise direction to move the cloth rightwardly until edge 10*a* is returned to a position between photo-receiving elements 8 and 9, at which time motor 4 is stopped. Thus, end 10*a* of the cloth article is automatically maintained at a desired position to ensure proper hemming during advancement of the sewing operation.

Figure 5A:
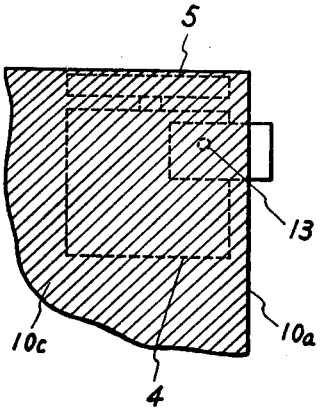
FIGS. 5*a* and 5*b* are partial side views showing the relationship between a third photo-receiving element and the unhemmed edge of the cloth, FIG. 5*a* showing the case where the unhemmed and unsewn edge covers the third photo-receiving element, and FIG. 5*b* showing the case where the beginning of the hemmed and sewn edge has approached and uncovered the position of third photo-receiving element.
Figure 5B:
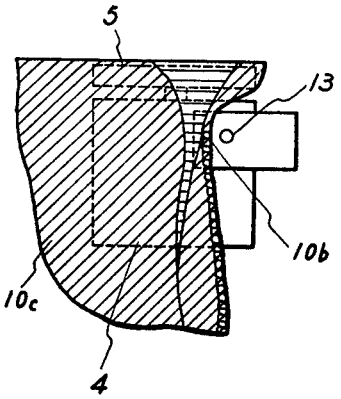

Thereafter, when sewing operation has advanced such that the hem is almost completed and such that beginning end 10*b* of the sewn hem has approached almost to the position of guide plate 5, beginning end 10*b* naturally will recede to follow a path to the left of the path of the unsewn edge, since the cloth is folded when sewn. Thus, third photo-receiving element 13 will be exposed as shown in FIG. 5*b*. Exposure of third photo-receiving element 13 will cause extension of air cylinder 23 as shown in FIG. 4. This will cause both cloth-handling bar 22 and cloth-pinching bar 24 to be raised, while still pinching the cloth therebetween, to a position such that the edge of the cloth is no longer curved over the edge of guide plate 5. By this action, beginning end 10*b*, which would otherwise become entangled on guide plate 5 and cause jamming is allowed to advance without entangling. Further, to avoid sewn beginning end 10*b* from being inserted over cloth guide 11, thereby also causing jamming, when third photo-receiving element 13 is exposed, air cylinder 12 is retracted so that cloth guide 11 recedes rightwardly out of the path of beginning end 10*b*. Thus, sewing of the last short portion of the hem is continued without jamming.

Further, when beginning end 10*b* has reached a position such that duplicate sewing of the hem would occur, a delay signal from third photo-receiving element 13 operates air cylinder 20 to raise folder 14 to the original position shown in FIG. 1. Thus, the finished sewn cloth article will fall downwardly out of cavity 15, and at the same time a further delay signal from third photo-receiving element 13 is sent to motor 4 to rotate guide plate 5 clockwise to thereby move the cloth leftwardly so that it will be removed from the sewing machine. At this moment, the entire sewing operation of the sewing machine is stopped by a further delay signal or by other conventional stop means. Thus, the entire stretch-sewing operation has been completed, and the hemmed cloth article can be removed from the sewing machine by cutting the remaining thread.

In the present invention, the entire hemming operation is performed automatically at high efficiency without the necessity of a skilled operator.

It is to be understood that the terms "cloth", "cloth article" and "article of clothing" as employed herein are not intended to limit the present invention to a particular material or to a particular type of element to be sewn.

Further, although the particular control circuitry involving control of motor 4 by photo-receiving elements 8 and 9, control of cylinders 23 and 12 by photo-receiving element 13, delayed control of cylinder 20 and motor 4 by element 13, and shut down of the sewing machine have not specifically been illustrated for clarity of description and illustration, and since such controls would be readily understood, it is to be understood that such control circuitry may include any known and conventional machine controls.

Finally, it will be apparent that various modifications may be made to the above specifically described procedures and structural arrangements without departing from the scope of the present invention.

What is claimed is:

1. A machine for forming and sewing a hem in the marginal portion of a workpiece, said machine comprising:

stitch forming means operable to grip a first portion of a workpiece having a hem folded in a marginal portion thereof and to sew said hem;

means for feeding said workpiece through said stitch forming means;

a circular guide plate positioned upstream of said stitch forming means, in the direction of feed of said workpiece, said guide plate having an upper flat surface extending in a plane which is parallel to said direction of feed and an annular peripheral surface;

gripping means for gripping the workpiece at a position thereof upstream of said guide plate and for forcing said workpiece against said upper flat surface of said guide plate and downwardly so that the marginal portion of said workpiece contacts and travels along said annular peripheral surface of said guide plate, whereby as said feeding means feeds said marginal portion of said workpiece over said annular peripheral surface and then over said upper flat surface of said guide plate, said marginal portion has automatically formed therein a substantially Z-shaped fold;

fold guide means positioned downstream of said guide plate for extending into the thus formed fold and to interiorly guide said fold as said workpiece is fed in said direction of feed;

hemming guide means positioned between said fold guide means and said stitch forming means for exteriorly guiding said fold as said workpiece is fed in said direction of feed; and said fold guide means and said hemming guide means together forming said Z-shaped fold into a triple-thickness hem which is thereafter sewn by said stitch forming means.

2. A machine as claimed in claim 1, further comprising means for maintaining a predetermined alignment of the edge of said marginal portion of said workpiece with respect to said direction of feed.

3. A machine as claimed in claim 2, wherein said alignment maintaining means comprises detector means positioned adjacent said guide plate for detecting shifting of the position of said edge away from said predetermined alignment, and control motor means attached to said guide plate and responsive to said detector means for rotating said guide plate and thereby moving said workpiece by an amount sufficient to return said edge to said predetermined alignment.

4. A machine as claimed in claim 3, wherein said detector means comprises first and second photo-receiving elements, said second photo-receiving element being further spaced from said guide plate than said first photo-receiving element, said control motor means being deactivated when said first photo-receiving element is covered by said workpiece and said second photo-receiving element is exposed, said control motor means being activated to rotate said guide plate in a counterclockwise direction when both said first and second photo-receiving elements are exposed, and said control motor means being activated to rotate said guide plate in a clockwise direction when both said first and second photo-receiving elements are covered by said workpiece.

5. A machine as claimed in claim 1, wherein said workpiece is tubular in configuration, and further comprising means for detecting the return of the intitial portion of the sewn hem to a position adjacent said guide plate, and means responsive to said detecting means for preventing jamming of said initial sewn hem portion with said guide plate and said fold guide means during sewing of the final portion of the hem.

6. A machine as claimed in 5, wherein said detecting means comprises a photo-receiving element positioned adjacent to said guide plate to be covered by an unfolded marginal portion of said workpiece and to be exposed when said initial sewn hem portion approaches said guide plate, and said jamming preventing means comprises means responsive to exposure of said photo-receiving element for raising said gripping means such that said workpiece is no longer forced downwardly along said annular peripheral surface of said guide plate and for withdrawing said fold guide means from the interior of said fold.

7. A machine as claimed in claim 6, further comprising means, responsive to exposure of said photo-receiving element after a predetermined time delay sufficient for sewing said final portion of the hem, for raising said hemming guide means and thereby allowing the hemmed workpiece to drop therefrom and for rotating said guide plate in a clockwise direction and thereby moving the hemmed workpiece off said guide plate.

* * * * *